US009677215B2

(12) United States Patent
Kim et al.

(10) Patent No.: US 9,677,215 B2
(45) Date of Patent: Jun. 13, 2017

(54) LAUNDRY TREATING APPARATUS

(71) Applicant: LG ELECTRONICS INC., Seoul (KR)

(72) Inventors: Hyojun Kim, Seoul (KR); Sangwook Hong, Seoul (KR); Youngsuk Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/920,148

(22) Filed: Oct. 22, 2015

(65) Prior Publication Data

US 2016/0115639 A1 Apr. 28, 2016

(30) Foreign Application Priority Data

Oct. 28, 2014 (KR) ..... 10-2014-0147788

(51) Int. Cl.

| | |
|---|---|
| ***D06F 58/22*** | (2006.01) |
| ***D06F 58/26*** | (2006.01) |
| *D06F 58/20* | (2006.01) |
| *D06F 58/24* | (2006.01) |

(52) U.S. Cl.

CPC ..... *D06F 58/22* (2013.01); *D06F 58/26* (2013.01); *D06F 58/206* (2013.01); *D06F 58/24* (2013.01)

(58) Field of Classification Search

CPC ..... F26B 19/00; F26B 21/00; F26B 21/06; D06F 58/22; D06F 58/26

USPC ..... 34/595, 601, 610; 68/19, 20; 8/149, 159

See application file for complete search history.

(56) References Cited

U.S. PATENT DOCUMENTS

| | | | | |
|---|---|---|---|---|
| 5,628,122 | A * | 5/1997 | Spinardi | D06F 58/22 137/132 |
| 7,644,515 | B2 * | 1/2010 | Doh | D06F 58/22 34/603 |
| 8,166,670 | B2 * | 5/2012 | Poy | D06F 58/22 34/140 |

(Continued)

FOREIGN PATENT DOCUMENTS

| | | |
|---|---|---|
| CN | 103282574 | 9/2013 |
| CN | 103608508 | 2/2014 |

(Continued)

OTHER PUBLICATIONS

Australian Office Action dated Jun. 3, 2016 issued in Application No. 2015249045.

(Continued)

*Primary Examiner* — Stephen M Gravini
(74) *Attorney, Agent, or Firm* — KED & Associates, LLP

(57) ABSTRACT

A laundry treating apparatus is provided that may include a laundry accommodation device that provides a space in which laundry may be accommodated, the laundry accommodation device having an exhaust device that exhausts air and a supply device that supplies air; a circulation passage that guides air exhausted from the exhaust device to the supply device, the circulation passage having an inlet that communicates with the exhaust device; a heat exchanger provided in the circulation passage; a filter frame provided between the heat exchanger and the inlet; a filter fixed to the filter frame and provided in the circulation passage; and a filter washer fixed to the filter frame, that supplies washing water to the filter.

16 Claims, 11 Drawing Sheets

(56) References Cited

U.S. PATENT DOCUMENTS

| | | | | |
|---|---|---|---|---|
| 8,201,345 | B2 * | 6/2012 | Dalton | D06F 58/203 34/389 |
| 8,240,064 | B2 * | 8/2012 | Steffens | D06F 58/22 34/210 |
| 8,656,604 | B2 * | 2/2014 | Ediger | D06F 58/206 134/30 |
| 8,800,165 | B2 * | 8/2014 | Kwon | D06F 25/00 134/18 |
| 8,863,405 | B2 * | 10/2014 | Lee | D06F 58/20 34/134 |
| 9,027,256 | B2 * | 5/2015 | Kim | F26B 21/003 34/86 |
| 9,052,142 | B2 * | 6/2015 | Kim | F26B 21/003 |
| 9,163,352 | B2 * | 10/2015 | Han | D06F 58/26 |
| 9,194,073 | B2 * | 11/2015 | Kwon | D06F 25/00 |
| 9,279,211 | B2 * | 3/2016 | Kim | D06F 58/26 |
| 2004/0221474 | A1 * | 11/2004 | Slutsky | D06F 25/00 34/319 |
| 2008/0276656 | A1 | 11/2008 | Kitamura et al. | |
| 2010/0146811 | A1 | 6/2010 | Steffens | |
| 2010/0154240 | A1 | 6/2010 | Grunert | |
| 2011/0173834 | A1 * | 7/2011 | Arrigoni | D06F 58/22 34/90 |
| 2013/0219734 | A1 | 8/2013 | Kim et al. | |
| 2016/0115636 | A1 * | 4/2016 | Kim | D06F 39/088 68/18 F |
| 2016/0115639 | A1 * | 4/2016 | Kim | D06F 58/26 34/82 |

FOREIGN PATENT DOCUMENTS

| | | | | |
|---|---|---|---|---|
| CN | 103774402 | | 5/2014 | |
| CN | 103797174 | | 5/2014 | |
| DE | 102008054548 | A1 * | 6/2010 | D06F 58/22 |
| DE | EP 2196577 | A1 * | 6/2010 | D06F 58/22 |
| DE | 10 2008 054 832 | A1 | 7/2010 | |
| DE | 10 2010 039 602 | A1 | 2/2012 | |
| DE | 10 2014 204 299 | A1 | 9/2015 | |
| DE | EP 2196577 | B1 * | 6/2016 | D06F 58/22 |
| EP | 1 669 487 | | 6/2006 | |
| EP | 2 039 819 | A1 | 3/2009 | |
| EP | 2 202 349 | | 6/2010 | |
| EP | 2 386 679 | | 11/2011 | |
| EP | 2 559 805 | | 2/2013 | |
| JP | 2006-187449 | A | 7/2006 | |
| KR | 10-2007-0076853 | A | 7/2007 | |
| WO | WO 2011/057954 | | 5/2011 | |
| WO | WO 2011/061068 | | 5/2011 | |
| WO | WO 2013/151345 | | 10/2013 | |
| WO | WO 2014/038112 | A1 | 3/2014 | |
| WO | WO 2014/115999 | | 7/2014 | |
| WO | WO 2014/169955 | A1 | 10/2014 | |

OTHER PUBLICATIONS

Australian Office Action dated Mar. 24, 2016 issued in Application No. 2015246161.

European Search Report dated Jan. 12, 2016.

European Search Report dated Mar. 14, 2016 issued in Application No. 15191431.4.

U.S. Appl. No. 14/919,931, filed Oct. 22, 2015.

Australian Office Action dated Oct. 31, 2016 issued in Application No. 2015246161.

Chinese Office Action dated Apr. 6, 2017 issued in Application No. 201510683291.3 (with English Translation).

* cited by examiner

LAUNDRY TREATING APPARATUS

CROSS-REFERENCE TO RELATED APPLICATION(S)

Pursuant to 35 U.S.C. §119(a), this application claims the benefit of earlier filing date and right of priority to Korean Application No. 10-2014-0147788, filed in Korea on Oct. 28, 2014, the contents of which is incorporated by reference herein in its entirety.

BACKGROUND

1. Field

A laundry treating apparatus is disclosed herein.

2. Background

A laundry treating apparatus includes an apparatus for washing or drying laundry, and an apparatus for washing and drying laundry. A laundry treating apparatus capable of drying laundry is configured to supply air at a high temperature (hot blast) to laundry, which may be classified into an exhaust type and a circulation type (condensation type) according to an air flow method.

The circulation type laundry treating apparatus includes structure to circulate air inside of a laundry accommodation unit or device in which laundry is placed. With this structure, air discharged from the laundry accommodation device is heated after moisture is removed (dehumidifying) from the air, and then the air is re-supplied to the laundry accommodation device.

The exhaustion type laundry treating apparatus includes structure to supply heated air to a laundry accommodation device. With this structure, air discharged from the laundry accommodation device is discharged outside of the laundry treating apparatus, without being circulated.

A hot air supply unit or device, provided at the conventional laundry treating apparatus, includes a blower configured to discharge air inside of a laundry accommodation unit, and a heat exchange unit or heat exchanger configured to heat air which flows by the blower. The heat exchange unit, a means to exchange heat with air, may have lowered heat exchange efficiency, in a case in which foreign materials are laminated thereon.

BRIEF DESCRIPTION OF THE DRAWINGS

Embodiments will be described in detail with reference to the following drawings in which like reference numerals refer to like elements, and wherein.

DETAILED DESCRIPTION

Figure 1:
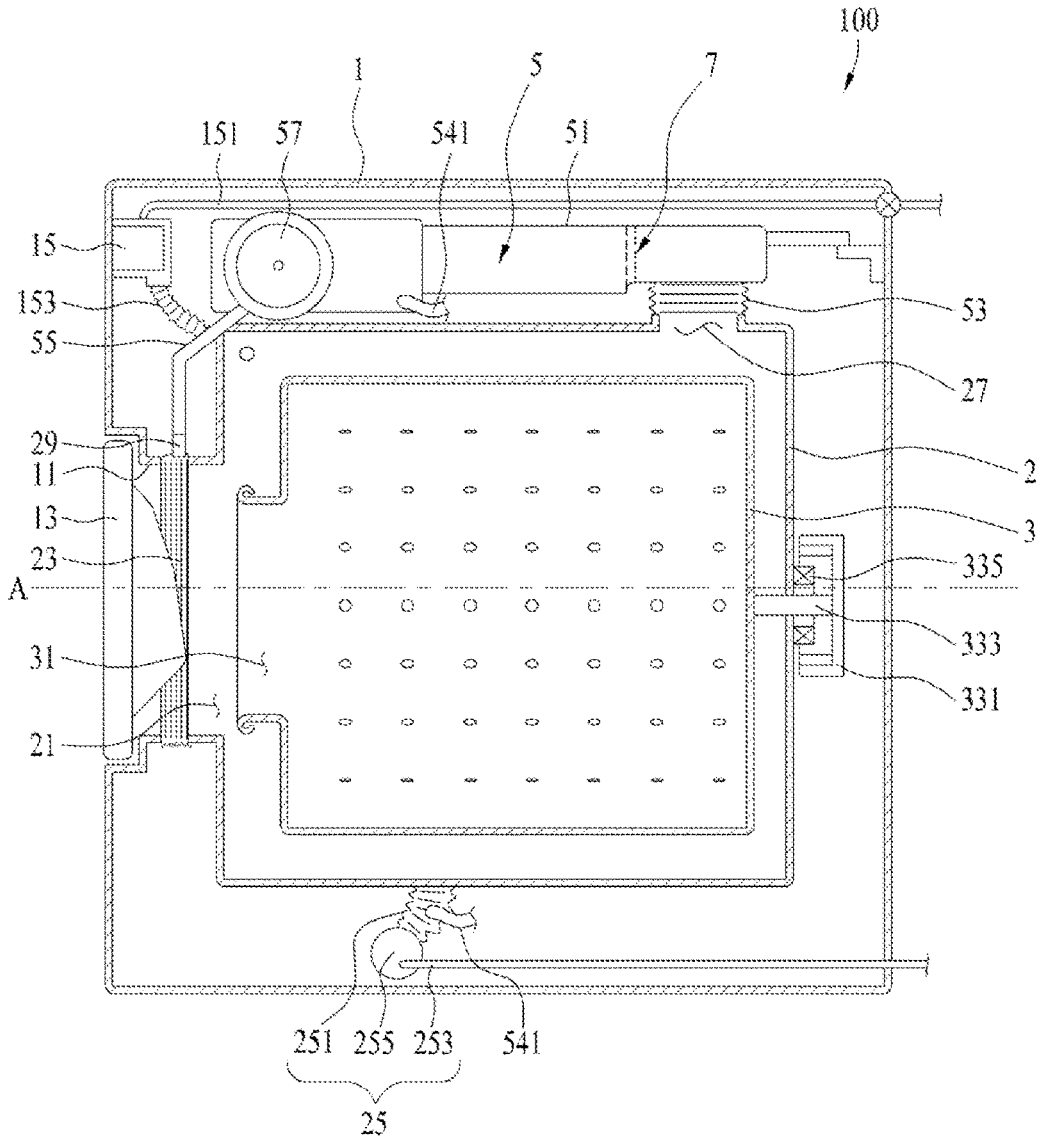
FIGS. 1 and 2 are cross-sectional and perspective views of a laundry treating apparatus according to an embodiment.

FIG. 1 is a cross-sectional view of a laundry treating apparatus according to an embodiment. As shown in FIG. 1, laundry treating apparatus 100 may include a cabinet 1, which forms an outer appearance thereof, laundry accommodation units or devices 2 and 3 provided in the cabinet 1 to accommodate laundry therein, and a hot blast supply unit or device 5 that supplies a hot blast to the laundry accommodation devices 2 and 3. The cabinet 1 may include an introduction opening 11, into which laundry may be introduced, and a door 13 rotatably provided at the cabinet 1 to open and close the introduction opening 11.

In a case in which the laundry treating apparatus 100 serves as an apparatus for only drying laundry, the laundry accommodation devices may be provided with only a drum 3 rotatably provided in the cabinet 1. On the other hand, if the laundry treating apparatus 100 serves as an apparatus for washing and drying laundry, the laundry accommodation devices may be provided with a tub 2 provided in the cabinet 1 to accommodate washing water therein, and a drum 3 rotatably provided in the cabinet 1 to accommodate laundry therein.

The tub 2 may have a hollow cylindrical shape, and be fixed to an inside of the cabinet 1. A tub introduction opening 21, through which laundry may be introduced, may be provided on or at a front surface of the tub 2 and correspond to the introduction opening 11.

A gasket 23 may be provided between the tub introduction opening 21 and the introduction opening 11. The gasket 23 may prevent washing water stored in the tub 2 from leaking outside of the tub 2, and prevent vibrations from the tub 2 from being transmitted to the cabinet 1 when the drum 3 is rotated. Thus, the gasket 23 may be a vibration isolation member, and may be formed of rubber.

The tub 2 may be installed such that a central longitudinal axis of the tub 2 extends parallel to a ground surface on which the cabinet 1 is supported, or may be installed with a predetermined inclination angle with respect to the ground surface. If the tub 2 is installed with an inclination of a predetermined angle with respect to the ground surface, the predetermined inclination angle may be less than about 90°.

An exhaust unit or device 27, through which air inside the tub 2 may be discharged, may be provided at an upper portion of a circumferential surface of the tub 2. A drain unit or device 25 that discharges the washing water stored in the tub 2 may be provided at a lower portion of the tub 2.

The exhaust device 27 is provided in the tub 2. The exhaust device 27 may be spaced a predetermined distant from a straight line (A) that passes through a center of the tub 2, for example, a predetermined distance (L1) (refer to FIG. 2). The reason is to easily discharge air inside of the tub 2 from the tub 2 through the exhaust device 27 when the drum 3 is rotated.

The drain device 25 may include a drain pump 255, a first drain pipe 251 that connects the drain pump 255 with the tub 2, and a second drain pipe 253 that guides washing water introduced into the drain pump 255 outside of the cabinet 1.

The tub 2 may be supplied with washing water through a water supply pipe 151 that connects the tub 2 with a water supply source. If a detergent supply unit or device 15 that supplies detergent to the tub 2 is provided at the cabinet 1, the water supply pipe 151 may be provided to supply washing water to the detergent supply device 15. In this case, the washing water supplied to the detergent supply device 15 may be supplied to the tub 2 through a detergent supply pipe 153.

The drum 3 may have a hollow cylindrical shape, and may be provided in the tub 2. The drum 3 may be rotatable by a drive provided outside of the tub 2. In this case, the drive may include a stator 335 fixed to a rear surface of the tub 2, a rotor 331 rotated by an electromagnetic operation with the stator 335, and a rotational shaft 333 that connects a rear surface of the drum 3 with the rotor 331 by passing through the rear surface of the tub 2.

A drum introduction opening 31, which may communicate with the introduction opening 11 and the tub introduction opening 21, may be provided on a front side of the drum 3. With such a configuration, a user may put laundry into the drum 3 through the introduction opening 11, or may withdraw laundry stored in the drum 3 outside of the cabinet 1.

Figure 2:
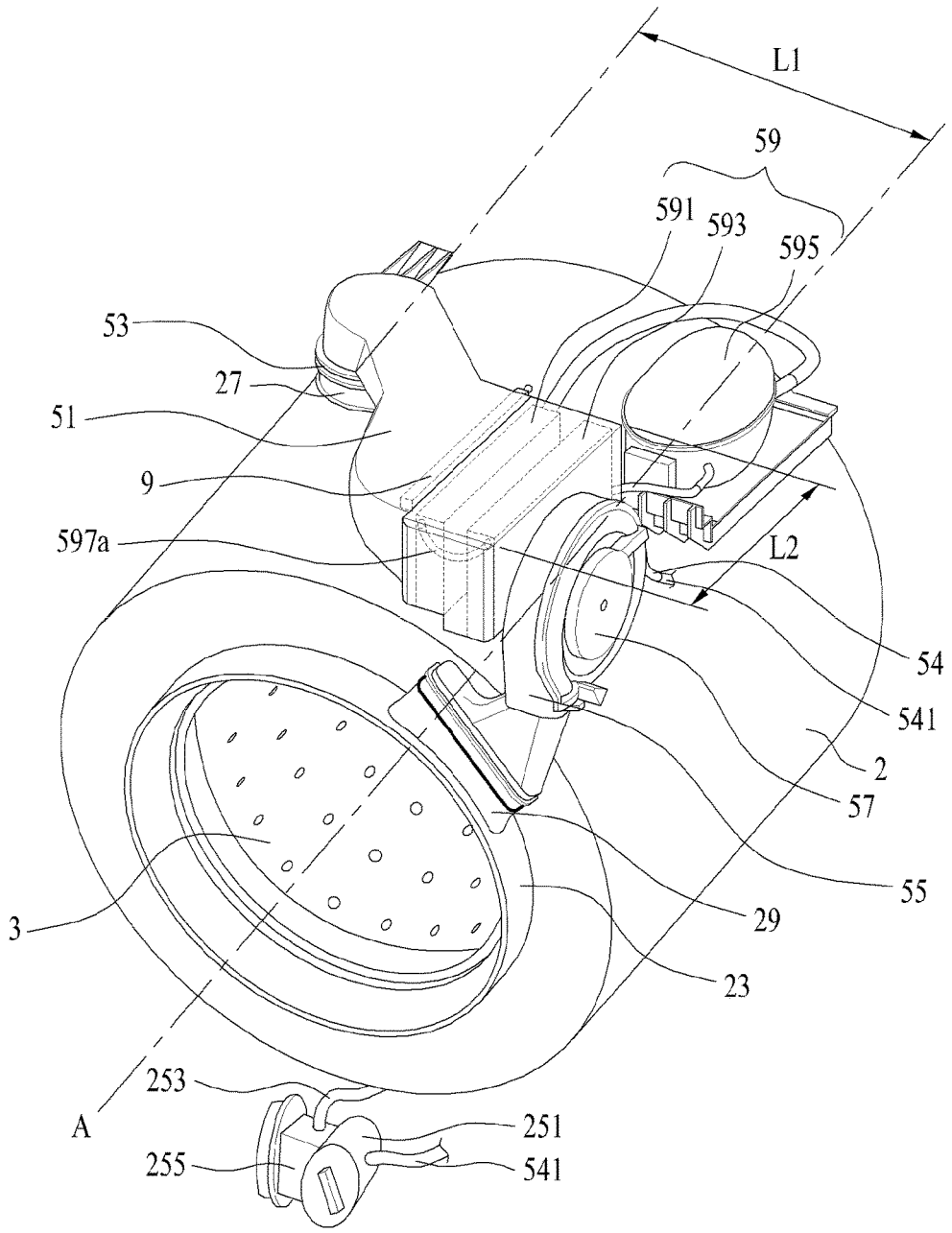

As shown in FIG. 2, the hot blast supply device 5 may include circulation passages 51, 53, and 55 that guide air discharged from the inside of the tub 2 to a front side of the tub 2, a blower 57 provided at or in the circulation passages 51, 53, and 55 that circulates air inside of the tub 2, and a heat exchange unit or heat exchanger 59 provided in the circulation passages 51, 53, and 55. The circulation passages 51, 53, and 55 may include a first connection duct 53 connected to a rear side of the tub 2, a duct 51 connected to the first connection duct 53 and having the heat exchanger 59 provided therein or thereon, and a second connection duct 55 that guides air discharged from the duct 51 to a front side of the tub 2.

The first connection duct 53 may be a passage connected to the exhaust device 27 provided on or at a rear side of the circumferential surface of the tub 2, and may be a vibration isolation member, and may be formed of rubber. This may prevent vibrations transmitted to the tub 2 from being transmitted to the heat exchanger 59 provided in the duct 51 through the first connection duct 53 when the drum 3 is rotated.

The first connection duct 53 may include a bellows, in order to effectively prevent transmission of vibrations generated from the tub 2, to the duct 51 and the heat exchanger 59. The second connection duct 55 may be connected to any point on the tub 2, if air discharged from the duct 51 is guided to a front side of the tub 2. FIG. 2 illustrates a case in which the second connection duct 55 supplies air into the tub 2 through the gasket 23. In this case, a supply unit or device 29 that communicates with the second connection duct 55 may be further provided at the gasket 23.

The blower 57 may be provided at the second connection duct 55. The blower 57 may include an impeller (not shown) provided in the second connection duct, and an impeller motor (not shown) that rotates the impeller 571.

Figure 3:
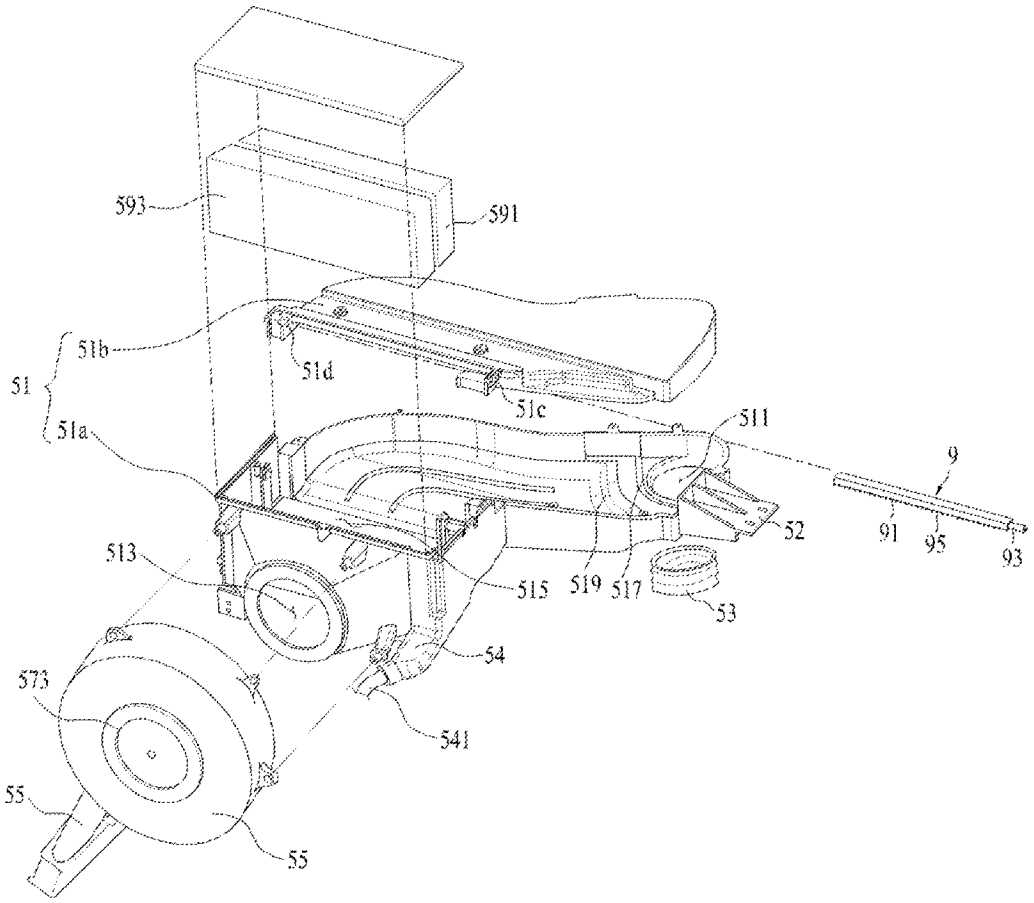
FIG. 3 is a view illustrating a circulation passage provided at a laundry treating apparatus according to an embodiment.

As shown in FIG. 3, an inlet 511 that communicates with the first connection duct 53, and a communication unit or device 513 that communicates with the second connection duct 55 may be provided at the duct 51. Thus, the duct 51 may serve as a means to guide air supplied into the inlet 511, to the second connection duct 55.

The duct 51 may include a base 51*a* to support the heat exchanger 59, and a cover 51*b* fixed to the base 51*a*. In this case, the inlet 511 and the communication device 513 may be provided at the base 51*a*.

The heat exchanger 59 may be a heat pump. A first heat exchanger 591 (evaporator) and a second heat exchanger 593 (condenser) provided at the heat exchanger 59 may be fixed to an inside of the duct 51, and a compressor 595 may be provided to supply a refrigerant discharged from the evaporator 591 to the condenser 593 after compressing the refrigerant. The refrigerant supplied to the condenser 593 may be re-supplied to the evaporator 591 via an expansion device 597.

Figure 4:
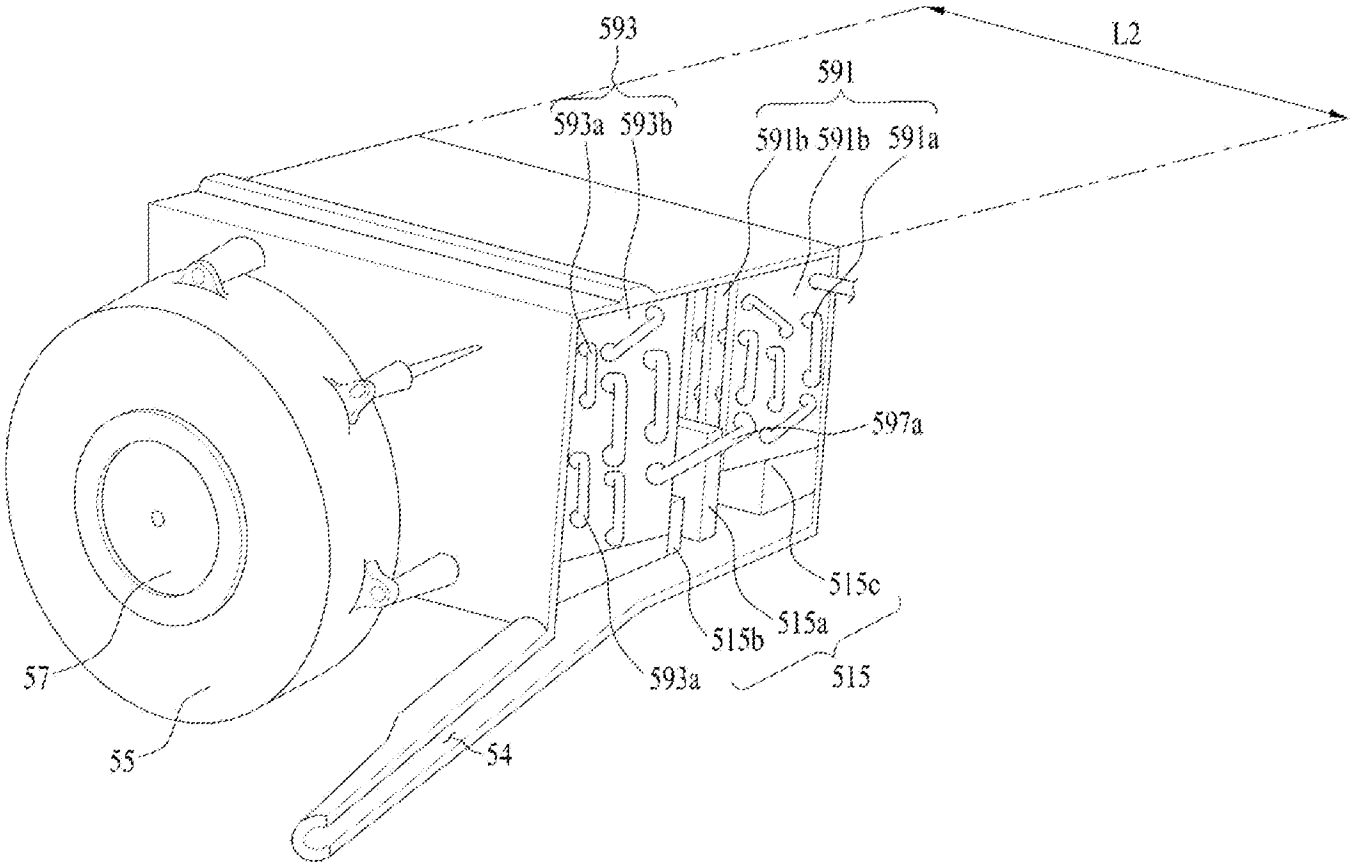
FIGS. 4, 5A and 5B are views illustrating a heat exchanger provided at a laundry treating apparatus according to an embodiment.

As shown in FIG. 4, the evaporator 591 may include first heat exchange plates 591*b*, and first refrigerant pipes 591*a* fixed to the first heat exchange plates 591*b*. For example, the first heat exchange plates 591*b* may include a plurality of metallic plates fixed in parallel in a lengthwise direction of the circulation passages (a moving direction of air). In this case, the first heat exchange plates 591*b* may be spaced from each other by a predetermined distance, in a widthwise direction (L2) of the circulation passages. The first refrigerant pipes 591*a*, which provide a moving path of a refrigerant, may be fixed to the first heat exchange plates 591*b*.

The evaporator 591 may evaporate a refrigerant after the refrigerant absorbs heat from air introduced into the duct 51. Thus, the evaporator 591 may serve as a means to remove moisture contained in air by cooling the air.

The duct 51 may further include a condensate water discharge unit or device 54 that discharges moisture removed from air (condensate water) by the evaporator 591 outside of the circulation passages. The condensate water discharge device 54 may be connected to the drain device 25 by a discharge pipe 541.

The condenser 593 may condense a refrigerant. Heat generated while a refrigerant is condensed may be transmitted to air passing through the condenser 593. Thus, the condenser 593 may serve as a means to heat air which has passed through the evaporator 591. The condenser 593 may include second heat exchange plates 593*b*, and second refrigerant pipes 593*a* fixed to the second heat exchange plates 593*b*.

The evaporator 591 and the condenser 593 may be fixed to a first mounting unit or device 515 provided in the duct 51. The first mounting device 515 may include a first supporting portion 515*c* that supports a lower surface of the evaporator 591, a second supporting portion 515*b* that supports a lower surface of the condenser 593, and a partition wall 515*a* provided between the evaporator 591 and the condenser 593. Such a configuration may prevent moisture removed from air passing through the evaporator 591 (condensate water) from moving to the condenser 593, and allow the condensate water to easily flow to the condensate water discharge device 54.

Figure 5A:
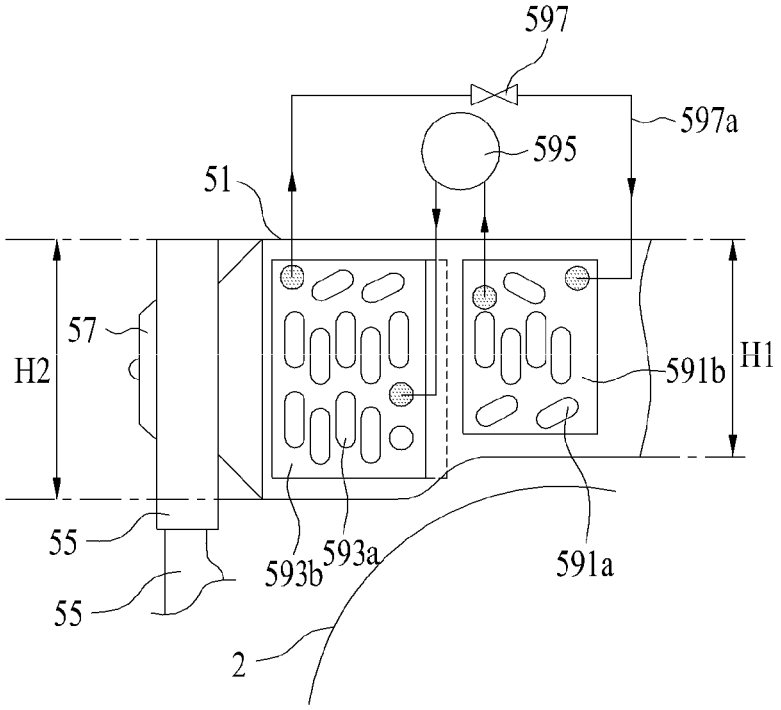

As shown in FIG. 5A, as the circulation passages 51, 53, and 55 may be positioned above the circumferential surface of the tub 2, and a space in which the evaporator 591 is positioned and a space in which the condenser 593 is positioned may have different volumes. If a duct height (H1) of a region in which the evaporator 591 is fixed is different from a duct height (H2) of a region in which the condenser 593 is fixed, a heat exchange amount of the evaporator 591 may be different from a heat exchange amount of the condenser 593. In this case, it may be difficult to solve such a difference between the heat exchange amount of the evaporator 591 and the heat exchange amount of the condenser 593, by merely increasing a volume of the evaporator 591 or the condenser 593, because the volume of the evaporator 591 or the condenser 593 is restricted by a shape of the duct 51.

More specifically, referring to FIG. 5A, it is difficult to increase a length of the second heat exchange plate 593*b* without changing a shape of the duct 51. The reason is because the second heat exchange plate 593*b* may interfere with the duct 51 even when a length of the second heat exchange plate 593*b* is increased toward the evaporator 591, for an increased volume of the condenser 593.

Figure 5B:
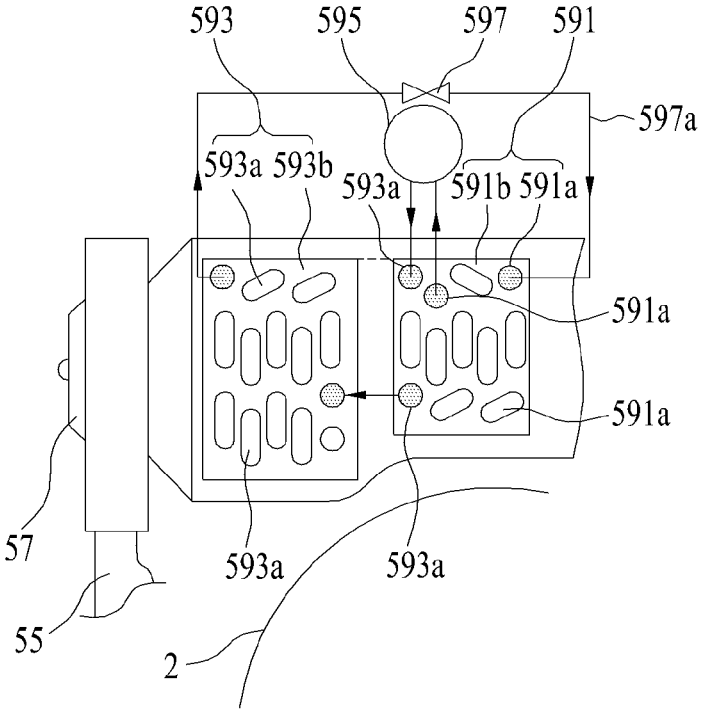

In order to solve such a problem, the condenser 593 may be formed such that a portion of its refrigerant pipes is fixed to the first heat exchange plates 591*b* of the evaporator 591. As shown in FIG. 5B, the evaporator 591 may include the first heat exchange plates 591*b* and the first refrigerant pipes 591*a* fixed to the first heat exchange plates 591*b*. The condenser 593 may include the second heat exchange plates 593*b* that exchange heat with air having passed through the first heat exchange plates 591*b*, and the second refrigerant pipes 593*a* fixed to the second heat exchange plates 593*b*. In this case, a portion of the second refrigerant pipes 593*a* may be fixed to the first heat exchange plates 591*b* of the evaporator 591.

More specifically, a refrigerant, which has passed through the first heat exchange plates 591*b* via the first refrigerant pipes 591*a*, may be introduced into the second refrigerant pipe 593*a* via the compressor 595. The second refrigerant pipe 593*a* may pass through the first heat exchange plates 591*b* and the second heat exchange plates 593*b*, sequentially. With such a structure, a length of the second refrigerant pipes 593*a* may be increased, and thus, a heat exchange amount of the evaporator 591 may become equal to a heat exchange amount of the condenser 593. Further, the refrigerant, discharged from the second heat exchange plates 593*b* through the second refrigerant pipes 593*a*, may be re-supplied to the first refrigerant pipes 591*a* via a connection pipe 597*a* and the expansion device 597.

Figure 6:
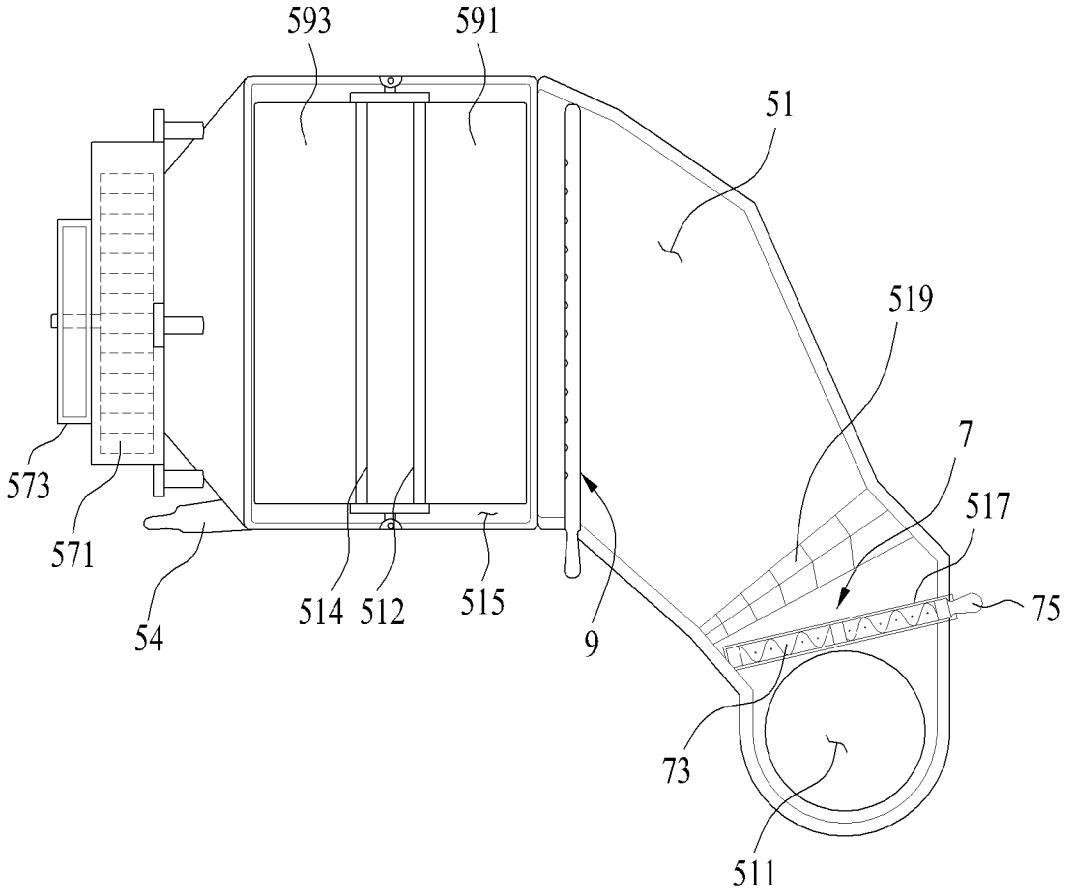
FIGS. 6, 7A and 7B are views illustrating a filter device provided at a laundry treating apparatus according to an embodiment.
Figure 7A:
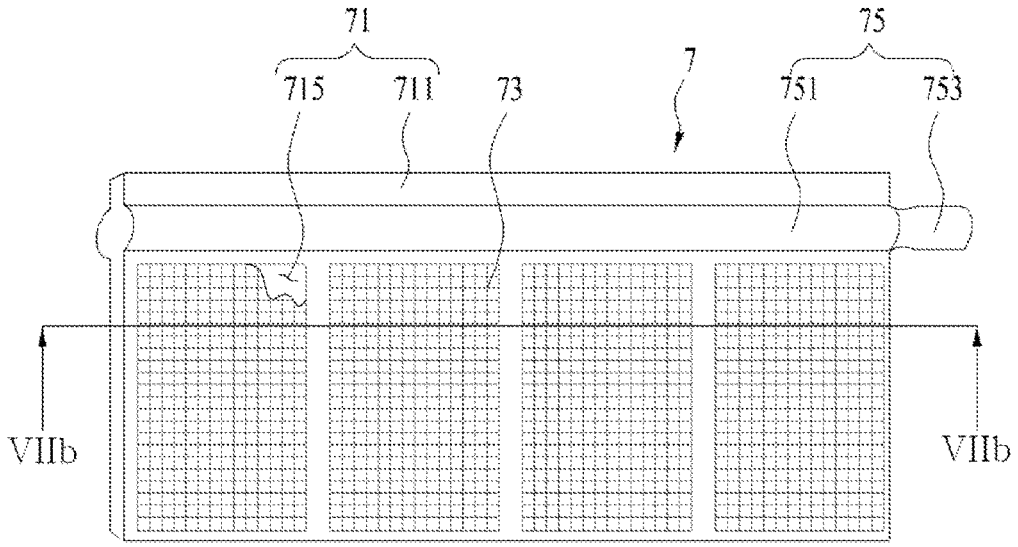
Figure 7B:
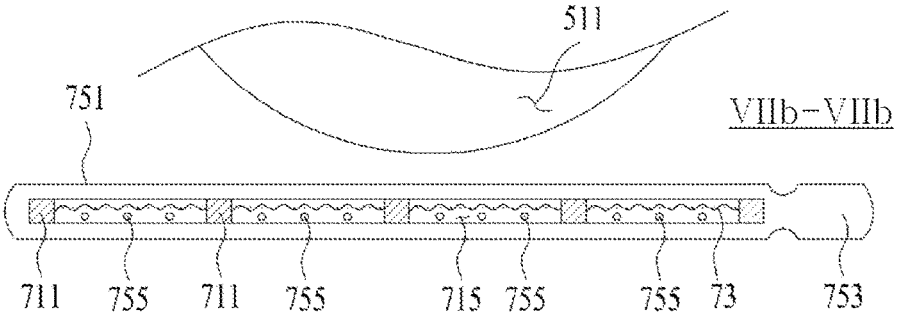

As shown in FIG. 6, the laundry treating apparatus 100 may further include a filter unit or device 7 that prevents lamination of foreign materials on the heat exchanger 59, by filtering air introduced into the circulation passages 51, 53, and 55 after being discharged from the tub 2. As shown in FIGS. 7A and 7B, the filter device 7 may include a filter frame 71 provided between the heat exchanger 59 and the inlet 511, a filter 73 fixed to the filter frame 71 to filter foreign materials and positioned on a sectional surface of the circulation passages, and a filter washer 75 fixed to the filter frame 71 to spray washing water to the filter 73.

The filter frame 71 may include a body 711 provided on a sectional surface of the duct 51, which may be perpendicular to an air flow direction, and an open surface 715 provided to pass through the body 711. In this case, the filter 73 may be fixed to the body 711, thereby being positioned at the open surface 715.

The filter washer 75 may include a passage body 751 fixed to the body 711 to introduce washing water thereinto, and one or more discharge hole 755 to discharge the washing water inside of the passage body 751 into the filter 73. The passage body 751 may be fixed to an upper portion of the open surface 715. The passage body 751 may be supplied with washing water from a water source, through a connection body 753 exposed to an outside of the duct 51 by passing through the duct 51.

The discharge hole(s) 755 may spray washing water, such that foreign materials remaining on the filter 73 may be moved toward the inlet 511, to introduce foreign materials separated from the filter 73 into the tub 2 via the inlet 511, the first connection duct 53 and the exhaust device 27, and then to discharge the foreign materials outside of the cabinet 1 when the drain device 25 is operated.

The filter device 7 may be detachably mounted to the circulation passages 51, 53, and 55. That is, the filter frame 71 may be provided so as to be withdrawn from the duct 51. For this, the duct 51 may further include an insertion hole (not shown) into which the filter frame 71 may be inserted.

As shown in FIG. 6, the duct 51 may further include a second mounting unit or device 517 to support the filter frame 71. In this case, the second mounting device 517 may be provided at a higher position than the first mounting device 515, in order to prevent condensate water generated by the heat exchanger 59 from being introduced into the inlet 511. The duct 51 may further include an inclined unit or device 519 downward-inclined from the second mounting device 517 towardly the first mounting device 515, to rapidly discharge washing water discharged from the discharge hole(s) 755, outside of the duct 51 through the condensate water discharge device 54, in a case in which a portion of the washing water discharged from the discharge hole(s) 755 is to be supplied to the heat exchanger 59.

The filter 73 may have a flat surface inclined from a sectional surface of the duct 51 by a predetermined angle, or may be formed to have a curved surface that protrudes in a direction that extends away from the inlet 511. Alternatively, the filter 73 may be formed to have a curved surface inclined from a sectional surface of the duct 51 by a predetermined angle. Such structures are implemented for maximization of a filtering capacity of the filter 73.

In a case in which the filter 73 has a flat surface inclined from a sectional surface of the duct 51 by a predetermined angle, a distance from a lower end of the filter 73 to the inlet 511 may be shorter or longer than a distance from an upper end of the filter 73 to the inlet 511. Considering that foreign materials may be moved to the inlet 511 by washing water sprayed from the discharge hole(s) 755, the distance from the lower end of the filter 73 to the inlet 511 may be shorter than the distance from the upper end of the filter 73 to the inlet 511.

Figure 8A:
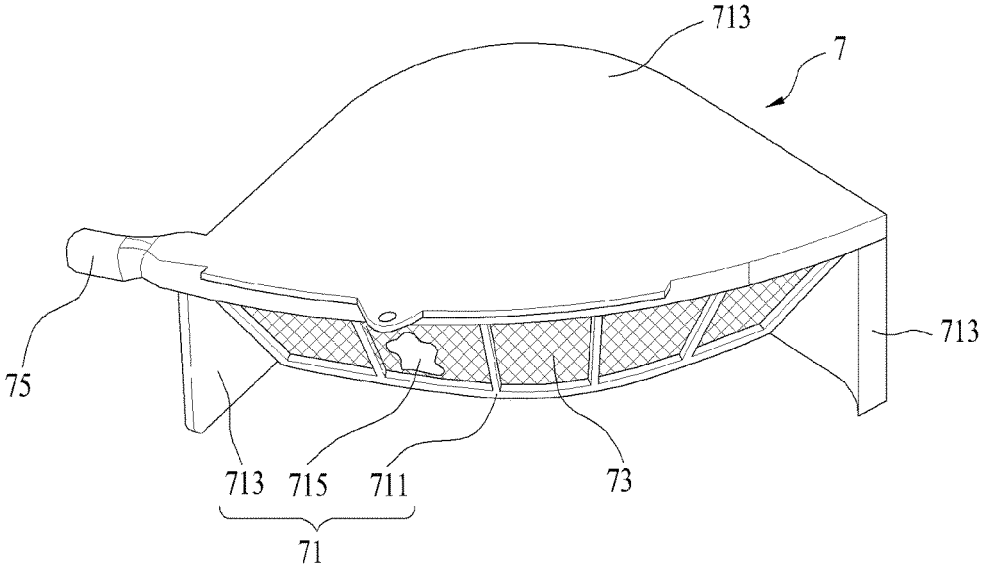
FIGS. 8A, 8B, 9A and 9B are views illustrating a filter device provided at a laundry treating apparatus according to another embodiment of the present invention.
Figure 8B:
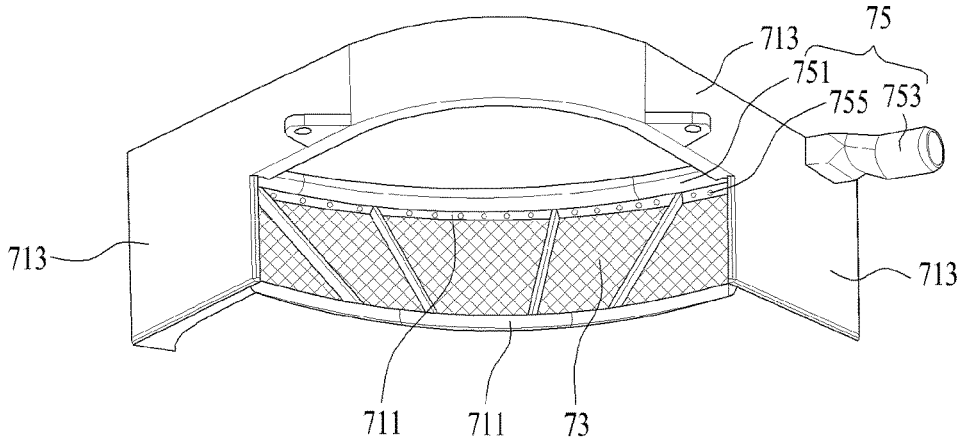

FIGS. 8A and 8B illustrate an example of the filter device 7 including the filter 73 having a curved surface inclined from a sectional surface of the duct 51 by a predetermined angle. In this embodiment, the filter device 7 may also include the filter frame 71 provided between the heat exchanger 59 and the inlet 511, the filter 73 fixed to the filter frame 71 to filter air and positioned on a sectional surface of the circulation passages (a sectional surface perpendicular to an air moving direction), and the filter washer 75 fixed to the filter frame 71 to spray washing water to the filter 73.

The filter frame 71 may include body 711 formed to be convex in a direction that extends away from the inlet 511, open surface 715 formed to pass through the body 711, and guider 713 that guides air introduced into the inlet 511 toward the open surface 715. As the filter 73 may be fixed to the open surface 715, the guider 713 may serve as a means to guide air introduced into the inlet 511 to the filter 73.

Figure 9A:
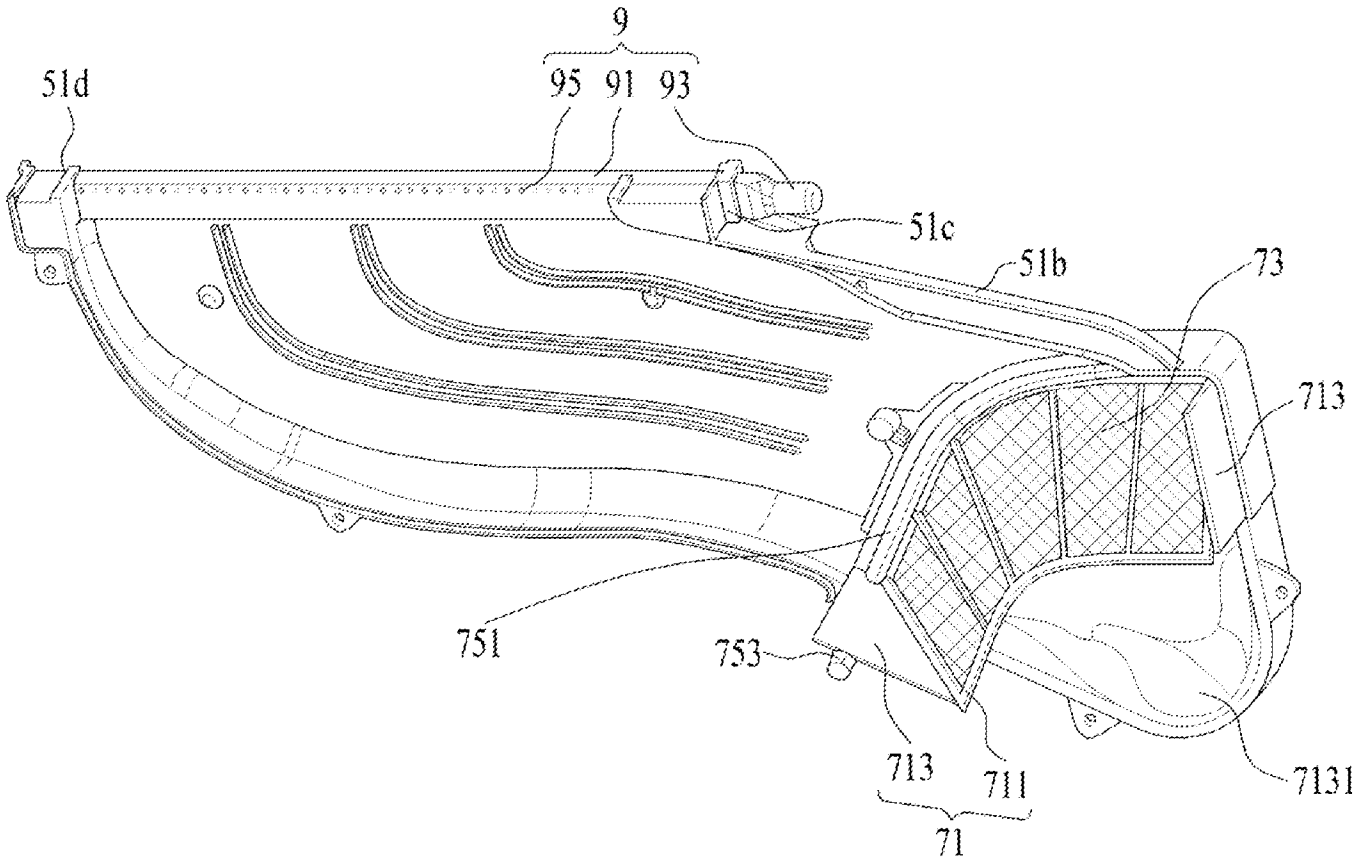

As shown in FIG. 9A, the guider 713 may be further provided with an inclined surface 7131 in order to minimize lowering of a flow speed of air which moves from the inlet 511 to the filter 73. In this embodiment, the filter 73 may be formed to be convex toward the heat exchanger 59. Accordingly, the passage body 751 of the filter washer 75, positioned on an upper end of the filter 73, may also be formed to have a curved surface convex toward the heat exchanger 59.

Figure 9B:
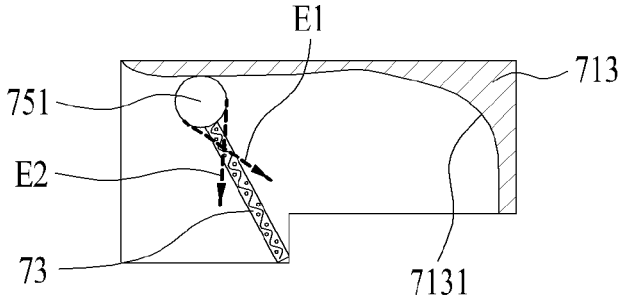

Referring to FIG. 9B, the discharge hole(s) 755 provided at the filter washer 75 may spray washing water toward the filter 73, from a rear side of the filter 73 (a direction toward the heat exchanger 59) (E1), or may spray washing water toward the filter 73, from a front upper side of the filter 73 (a direction toward the inlet) (E2).

As discussed above, the inclined device 519 (refer to FIG. 3) may be provided between the second mounting device 517 to support a lower end of the filter 73, and the first mounting device 515 to support the heat exchanger 59. Accordingly, in the latter case (E2), washing water may be discharged outside of the duct 51, through the condensate water discharge device 54. In the former case (E1), washing water sprayed from the discharge hole(s) 755 may be discharged outside of the circulation passages through the inlet 511.

In the laundry treating apparatus 100 having the aforementioned structure, foreign materials may be laminated on or attached to the heat exchanger 59. This may lower heat exchange efficiency. In order to solve such a problem, the laundry treating apparatus according to embodiments may further include washer 9 to spray washing water onto the heat exchanger 59.

As shown in FIG. 6 or 9A, the washer 9 may include a second passage body 91 provided in a widthwise direction of the circulation passages 51, 53, and 55 to introduce washing water thereinto, and one or more second discharge hole 95 to discharge the washing water inside of the second passage body 91 to the heat exchanger 59. The second passage body 91 may be detachably mounted to the circulation passages 51, 53, and 55. For this, the duct 51 may further include a first coupling unit or device 51*c* and a second coupling unit or device 51*d* each to support the second passage body 91. The first coupling device 51*c* may be a hole that passes through the cover 51*b* of the duct 51. The second coupling device 51*d* may be a groove provided at the cover 51*b*. The groove may support one end of the second passage body 91, which has been inserted into the first coupling device 51*c*. The second passage body 91 may be connected to a water source through a second connection body 93 formed to pass through the duct 51.

Embodiments disclosed herein provide a laundry treating apparatus capable of simultaneously cleaning a filter device that filters air supplied to a heat exchanger, and the heat exchanger.

Embodiments disclosed herein provide a laundry treating apparatus that may include a laundry accommodation unit or device configured to provide a space in which laundry may be accommodated, having an exhaust unit or device configured to exhaust air, and having a supply unit or device configured to supply air; a circulation passage configured to guide air exhausted from the exhaust unit to the supply unit, and having an inlet that communicates with the exhaust unit; a heat exchange unit or heat exchanger disposed or provided in the circulation passage; a filter frame disposed or provided between the heat exchange unit and the inlet; a filter fixed to the filter frame, and disposed or provided on a sectional surface of the circulation passage; and a filter washing unit or washer fixed to the filter frame, and configured to supply washing water to the filter. The filter frame may include a body provided at the circulation passage, and an open surface provided to pass through the body. The filter may be fixed to the open surface, and the filter washing unit may be fixed to the body.

The filter washing unit may include a passage body configured to introduce washing water thereinto, and disposed or provided above the open surface, and a discharge hole configured to discharge the washing water inside of the passage body into the filter. The discharge hole may be configured to spray washing water, such that foreign materials remaining on the filter may be moved toward the inlet.

The filter frame may be provided so as to be withdrawn from the circulation passage. A distance from a lower end of the filter to the inlet may be shorter than a distance from an upper end of the filter to the inlet. The distance from the lower end of the filter to the inlet may be longer than the distance from the upper end of the filter to the inlet. The filter may be formed to have a convex surface toward a direction which becomes far from the inlet.

The inlet may be provided on a plane that contacts a lower end of the filter. The filter frame may further include a guider configured to guide air introduced from the inlet toward the filter.

The laundry treating apparatus may further include a washing unit or washer configured to spray washing water to the heat exchange unit. The washing unit may include a second passage body disposed or provided in a widthwise direction of the circulation passage, and configured to introduce washing water thereinto, and a second discharge hole configured to discharge the washing water inside of the second passage body to the heat exchange unit.

The heat exchange unit may include a first heat exchange plate configured to exchange heat with air inside of the circulation passage; a first refrigerant pipe fixed to the first heat exchange plate; a second heat exchange plate disposed or provided in the circulation passage, and configured to exchange heat with air which has passed through the first heat exchange plate; a second refrigerant pipe fixed to the first and second heat exchange plates; a compression part or compressor configured to supply a refrigerant discharged from the first refrigerant pipe to the second refrigerant pipe, in a compressed manner; and an expansion part or device configured to move the refrigerant discharged from the second refrigerant pipe, to the first refrigerant pipe, after lowering a pressure of the refrigerant. The circulation passage may include a first mounting unit or device configured to support the heat exchange unit, and a second mounting unit or device configured to support a lower end of the filter frame, and disposed or provided at a higher position than the first mounting unit.

The circulation passage may further include a drain unit or device configured to discharge the water inside of the laundry accommodation unit, and a discharge pipe configured to connect the first mounting unit with the drain unit.

Embodiments disclosed herein provide a laundry treating apparatus having a filter device to filter air supplied to a heat exchange unit, and capable of cleaning the filter device.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

laundry accommodation device that provides a space in which laundry is accommodated, the laundry accommodation device having an exhaust device that exhausts air and a supply device that supplies air;

a circulation passage that glides air exhausted from the exhaust device to the supply device, the circulation passage having an inlet that accommodates the exhaust device;

a heat exchanger provided in the circulation passage;

a filter frame provided between the heat exchanger and the inlet;

a filter fixed to the filter frame and provided in the circulation passage; and a filter washer fixed to the filter frame, that supplies washing water to the filter, wherein the filter frame includes:

a body provided in the circulation passage; and an opening provided to pass through the body, wherein the filter is fixed to the opening, and wherein the filter washer is provided at and fixed to the body, and includes:

a passage body provided above the opening and into which washing water is received;

one or more discharge hole that discharges the washing water inside of the passage body to the filter; and a connection body exposed to an outside of the circulation passage by passing through the circulation passage and connected to a water source so as to supply the washing water to the passage body.

2. The laundry treating apparatus of claim 1, wherein the one or more discharge hole sprays washing water such that foreign materials remaining on the filter are moved toward the inlet.

3. The laundry treating apparatus of claim 1, wherein the filter frame is removably provided in the circulation passage.

4. The laundry treating apparatus of claim 1, wherein a distance from a lower end of the filter to the inlet is shorter than a distance from an upper end of the filter to the inlet.

5. The laundry treating apparatus of claim 1, wherein a distance from a lower end of the filter to the inlet is longer than a distance from an upper end of the filter to the inlet.

6. The laundry treating apparatus of claim 1, wherein the filter is formed to have a convex surface in a direction that extends away from the inlet.

7. The laundry treating apparatus of claim 6, wherein the inlet is provided on a plane in contact with a lower end of the filter, and wherein the filter frame further includes a guider that guides air introduced from the inlet toward the filter.

8. The laundry treating apparatus of claim 1, further including a heat exchanger washer configured to spray washing water onto the heat exchanger.

9. The laundry treating apparatus of claim 8, wherein the heat exchanger washer includes:

a passage body provided in a widthwise direction of the circulation passage, that receives washing water thereinto; and one or more discharge hole that discharges the washing water inside of the passage body to the heat exchanger.

10. The laundry treating apparatus of claim 1, wherein the heat exchanger includes:

at least one first heat exchange plate that exchanges heat with air inside of the circulation passage;

at least one first refrigerant pipe fixed to the at least one first heat exchange plate;

at least one second heat exchange plate provided in the circulation passage, that exchanges heat with air which has passed through the at least one first heat exchange plate;

at least one second refrigerant pipe fixed to the at least one first heat exchange plate and to the at least one second heat exchange plate;

a compressor that supplies a refrigerant discharged from the at least one first refrigerant pipe to the at least one second refrigerant pipe, in a compressed manner; and an expansion device that moves the refrigerant discharged from the at least one second refrigerant pipe, to the at least one first refrigerant pipe, after lowering a pressure of the refrigerant.

11. The laundry treating apparatus of claim 10, wherein the circulation passage includes:

a first mounting device that supports the heat exchanger; and a second mounting device that supports a lower end of the filter frame, wherein the second mounting device is provided at a higher position than a position of the first mounting device.

12. The laundry treating apparatus of claim 11, wherein the circulation passage further includes:

a drain device that discharges the water inside of the laundry accommodation device; and a discharge pipe that connects the first mounting device with the drain device.

13. A laundry treating apparatus, comprising:

a laundry accommodation device that provides a space in which laundry is accommodated, the laundry accommodation device having an exhaust device that exhausts air and a supply device that supplies air;

a circulation passage that guides air exhausted from the exhaust device to the supply device, the circulation passage having an inlet that accommodates the exhaust device;

a heat exchanger provided in the circulation passage;

a filter frame removably provided adjacent to the inlet;

a filter fixed to the filter frame and provided in the circulation passage; and a filter washer fixed to the filter frame, that supplies washing water to the filter, wherein the filter frame includes:

a body provided in the circulation passage; and an opening provided to pass through the body, wherein the filter is fixed to the opening, and wherein the filter washer is provided at and fixed to the body and includes:

a passage body provided above the opening and into which washing water is received;

one or more discharge hole that discharges the washing water inside of the passage body to the filter; and a connection body exposed to an outside of the circulation passage by passing through the circulation passage and connected to a water source so as to supply the washing water to the passage body.

14. The laundry treating apparatus of claim 13, wherein the filter is formed to have a convex surface in a direction that extends away from the inlet, wherein the inlet is provided on a plane in contact with a lower end of the filter, and wherein the filter frame further includes a guider that guides air introduced from the inlet toward the filter.

15. A laundry treating apparatus, comprising:

a laundry accommodation device that provides a space in which laundry is accommodated, the laundry accommodation device having an exhaust device that exhausts air and a supply device that supplies air;

a circulation passage that guides air exhausted from the exhaust device to the supply device, the circulation passage having an inlet that accommodates the exhaust device;

a heat exchanger provided in the circulation passage;

a filter frame provided adjacent to the inlet;

a filter fixed to the filter frame and provided in the circulation passage, wherein the filter is formed to have a convex surface in a direction that extends away from the inlet; and a filter washer fixed to the filter frame, that supplies washing water to the filter, wherein the filter frame includes:

a body provided in the circulation passage; and an opening provided to pass through the body, wherein the filter is fixed to the opening, and wherein the filter washer is provided at and fixed to the body and includes:

a passage body provided above the opening and into which washing water in received;

one or more discharge hole that discharges the washing water inside of the passage body to the filter; and a connection body exposed to an outside of the circulation passage by passing through the circulation passage and connected to a water source so as to supply the washing water to the passage body.

16. The laundry treating apparatus of claim 15, wherein the inlet is provided on a plane in contact with a lower end of the filter, and wherein the filter frame further includes a guider that guides air introduced from the inlet toward the filter.

* * * * *